US006250635B1

(12) United States Patent
Chittenden

(10) Patent No.: US 6,250,635 B1
(45) Date of Patent: Jun. 26, 2001

(54) DISC GOLF TARGET

(76) Inventor: Fred Chittenden, 2012 Grade Rd., Suite 201, Lake Stevens, WA (US) 98258

( * ) Notice: Subject to any disclaimer, the term of this patent is extended or adjusted under 35 U.S.C. 154(b) by 0 days.

(21) Appl. No.: 09/317,352

(22) Filed: May 24, 1999

(51) Int. Cl.[7] ..... A63B 67/06
(52) U.S. Cl. ..... 273/400; 473/476
(58) Field of Search ..... 473/400, 398, 473/401, 476, 479

(56) References Cited

U.S. PATENT DOCUMENTS 4,084,812 * 4/1978 Melrose ..... 273/400
4,809,988 * 3/1989 Hunter ..... 273/400
5,358,255 * 10/1994 Jolson ..... 273/400
5,452,903 * 9/1995 Larrabee ..... 273/400
5,868,395 * 2/1999 Headrick ..... 273/400
5,893,563 * 4/1999 Buller ..... 273/400
5,921,551 * 7/1999 Dunipace ..... 273/400

* cited by examiner

*Primary Examiner*—Mark S. Graham
(74) *Attorney, Agent, or Firm*—Todd N. Hathaway

(57) ABSTRACT

A disc golf target assembly. A plurality of curved support members and chain segments cooperate to intercept flying discs which enter the target. The curved support members deflect and disturb the flight path of the disc and reduce the momentum thereof. The chain segments arrest forward motion of the disc, and the disc drops into an underlying receiving area. The receiving area may be a basket structure mounted below the interception structure. The assembly may further include a raised stand structure. The curved support members may be elongate tubular members which extend over the receiving area. The support members may be arched outwardly or inwardly over the receiving area, and may be convertible between conf igurations. The support members and chain segments may also be selectively configured to give the target a directional bias, so that it more readily receives discs from one direction than from another.

20 Claims, 5 Drawing Sheets

DISC GOLF TARGET

BACKGROUND OF THE INVENTION a. Field of the Invention

The present invention relates generally to playing apparatus for disc golf games, and, more particularly, to a disc golf target having an improved structure for intercepting and capturing a disc which is directed at the target.

b. Related Art

Disc golf is an increasingly popular game in which plastic discs (somewhat similar to the discs sold under the trademark "FRISBEEI") are directed at a series of targets which are arranged to form a "course". The game is played according to rules which correspond roughly to those for conventional golf, and the course if often laid out in and around trees and other obstacles so as to present an increased challenge. Thus, the object is usually to start at a specified point and work towards the target, attempting to place the disc in the target with the least number of throws.

While several different types of targets are in use, most have some form of basket or other receptacle which is mounted on a post or other support, often with some form of structure being mounted above the basket for intercepting the disc so that it falls into the basket. A recurring problem, however, is that the discs (which must maintain a fairly high minimum speed in order to remain airborne) tend to bounce off of this structure, so that even if the player scores a direct "hit" the disc fails to fall into the basket. In some prior designs the interception structure has been provided with a conical surface in an effort to deflect the discs into the basket, but the tendency has still been for the disc to bounce off of the structure instead of being captured.

Another disadvantage of prior types of targets is that these have generally been limited to having a single configuration. In other words, even though the targets may be arranged about a course, the targets themselves are all identical, thereby limiting the challenge to the players. For example, most prior targets have tended to be "omni-directional", in that they are designed to receive a disc which enters them from any direction. Thus, these targets allow all putts to be made by throwing the disc straight at the target.

To make the course more challenging or to take advantage of certain obstacles, however, it may be desirable to configure some of the targets so that they are "directional" in nature, so that they more readily intercept and receive a disc entering from one direction than from another. For example, a directionally-biased target could be used to require the player to use a more challenging, curved flight path to "hole out" from a distance, rather a simple, straight throw.

Still further, it would be desirable in certain applications to be able to selectively re-configure individual target assemblies, so as to be able to provide a varying challenge without having to purchase additional or different target assemblies. Again, prior forms of targets generally have only a single configuration, thereby obviating any such option.

Consequently, there exists a need for a disc golf target having a structure which reduces or eliminates the problem of discs bouncing off of the target when it is properly hit. Furthermore, there exists a need for such target which can be configured so as to be directional in nature, i.e., so that the target will more preferentially receive discs from one or more selected directions. Still further, there exists a need for such a target which can be re-configured so as to vary the challenge which is offered thereby. Still further, there exists a need for such a target which is economical to manufacture, and which is durable and long-lasting in use.

SUMMARY OF THE INVENTION

The present invention has solved the problems cited above, and is a target assembly having an upper section which comprises one or more curved support members and chain segments which cooperate to intercept and capture a flying disc.

In a preferred embodiment, the upper interception structure comprises a plurality of curved support members which arch above a lower basket section of the assembly. A plurality of chain segments are supported from the curved support members, so that a disc entering the interception structure will tend to strike both the support members and the chain segments. The curved support members break the flight of the disc and change its direction, dissipating the kinetic energy thereof so as to facilitate arrest of the disc by the chain segments. The curvature of the support members also reduces the likelihood of the disc bouncing off of the target assembly in the event of a direct impact against a support member.

The assembly may be made up of a plurality of flexible support members which can be re-configured between alternate configurations. The support members forming the upper, interception structure may be elongate tubular members. The basket and support structures of the assembly may also be formed of tubular support members.

DETAILED DESCRIPTION a. Structure

As noted above, FIG. 1 shows a disc golf target 10 in accordance with the present invention. In this embodiment the target is constructed as a lightweight, portable assembly, although it will be understood that in other embodiments the target may be constructed as a permanently installed, non-portable structure. Furthermore, it will be understood that while the embodiment which is shown in the figures has the advantage of being convertible between directional and non-directional configurations, in some embodiments the invention may be constructed as a non-convertible unit.

Figure 1:
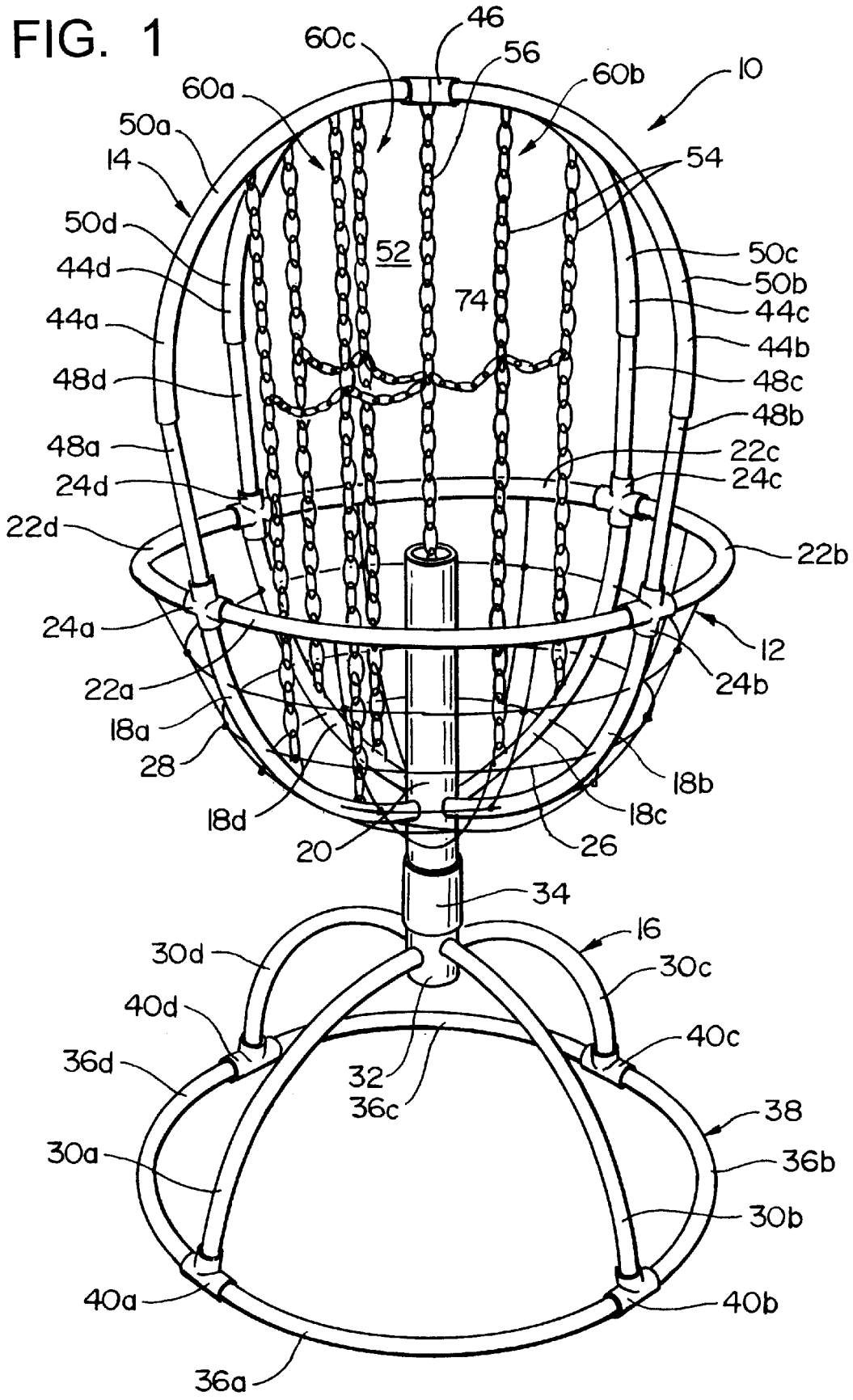
FIG. 1 is a perspective view of a disc golf target assembly in accordance with the present invention, showing the upwardly projecting structure which intercepts the disc and directs this into an underlying basket structure.

Accordingly, the target assembly 10 which is shown in FIG. 1 includes a basket structure 12 and an upwardly extending interception structure 14 which are mounted on a portable base structure 16. The framework of the assembly is constructed principally of a plurality of tubular members mounted to one another. For example, the assembly is suitably constructed of polyvinylchloride (PVC) pipe and associated fittings. Other suitable materials include polyethylene pipe, particularly where flexibility and easy convertibility of the structure are desired. In other instances, however, such as where a stronger or more permanent structure is desired, the framework can be constructed using metal tubing, such as galvanized steel pipe, for example. Accordingly, it will be understood that the terms "tube", "tubing", "tubular" and the like, as used herein, mean all such elongate members having an external configuration generally in the manner of a tube or pipe, regardless of material or whether these have hollow or solid interiors.

As is shown in FIG. 1, the basket structure 12 is thus formed of a series of outwardly and upwardly curved tubular segments 18*a–d* which are extend radially from a central pillar tube 20. The upper ends of the curved basket segments are joined to a generally circular rim which is formed of a plurality of curved, horizontally extending rim segments 22*a–d*.

In the embodiment which is illustrated (which is suitably constructed of PVC pipe), the connections between the basket and rim segments are formed using four-way pipe connectors 24*a–d*, with an end of a basket segment being mounted to the lower end of each pipe connector and the ends of first and second rim segments being mounted to the two side arms of the connector. Moreover, in those embodiments where the curved segments are include a section of polyethylene pipe or a similar material, a short segment or "nipple" of PVC pipe may be inserted into the end of the flexible segment and then into the connector to form the joint.

The curved rim and basket members support interlaced strands 26, which extend vertically and horizontally so as to form a basketwork which spans the gaps between the supports. The strands, which may suitably be formed of ¼-inch flexible PVC or polyethylene plastic rod, are threaded through corresponding bores in the basket and rim members, with the junctions 28 between the strands being secured using a small ties, straps, sleeves, clips or other suitable connectors.

A vertical pillar tube 20 extends downwardly from the basket structure for attachment to an underlying support. In the embodiment which is illustrated, the support is provided by the stand structure 16, although it will be understood that in other embodiments the support may be a post or socket which is mounted to the ground for engaging the pillar tube, or the pillar tube itself may be cemented or otherwise mounted directly to the ground or other substrate.

The stand structure 16 is somewhat similar in construction to the basket structure described above, in that this made up a plurality of outwardly and downwardly arched tubular leg members 30*a–d* which extend radially from a vertical center tube 32. The upper end of tube 32 is mounted in coaxial alignment with pillar tube 20 by means of a connecting sleeve 34, so that the two sections can be separated for transportation or storage.

Figure 9:
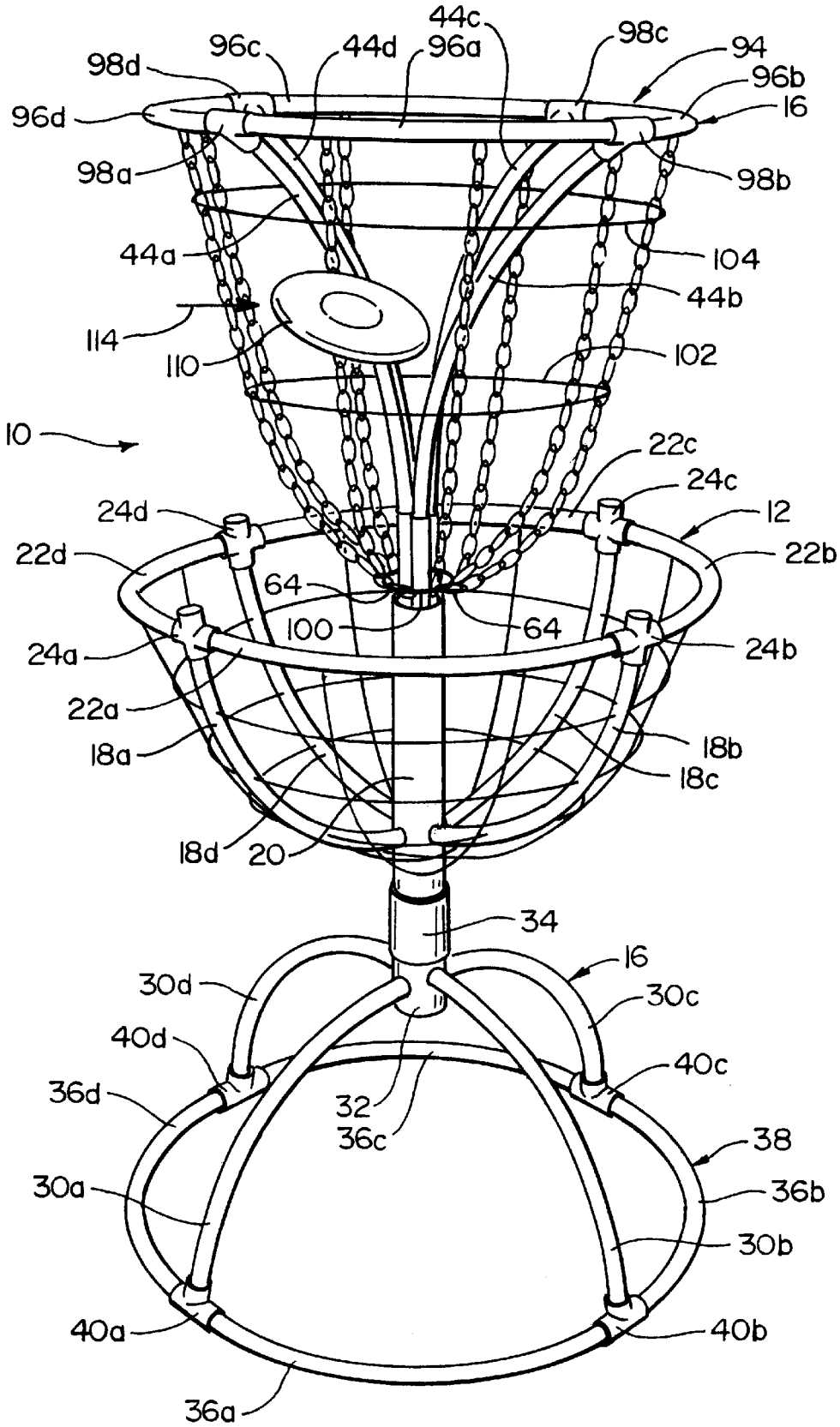
FIG. 9 is a perspective view, similar to FIG. 1, showing the target assembly of FIGS. 1–2 having been rearranged into a second configuration, in which the target will freely intercept and receive discs which impact it from any direction.

At their lower ends, the leg members 30*a–d* are mounted to a generally circular base ring 38 which is formed of a plurality of curved rim members 36*a–d*. As with the members described above, the leg and rim members are joined by means of suitable pipe connectors, although three-legged "T" connectors 40*a–d* are used rather than the four-way connectors described above. The leg members and a base ring thus provide a broad, stable support for the upper portions of the target assembly. It will be understood, however, that the stand structure may have other suitable configurations, such as, for example, a configuration similar to the upper rim and supports of the assembly which is shown in FIG. 9, but inverted, which has the advantage of being adjustable so as to level the target when it is placed on a slope.

Turning now to the disc interception structure 14, it can be seen that this includes a plurality of tubular support members 44*a–d* which extend upwardly and somewhat outwardly from the circular rim of the basket structure, and then arch back inwardly over the top of the assembly. The lower ends of the support members are mounted to the upper legs of the pipe connectors 24*a*–24*d* around the rim of the basket structure, while the upper ends of the support members are joined together by another four-way connector 46.

Figure 2:
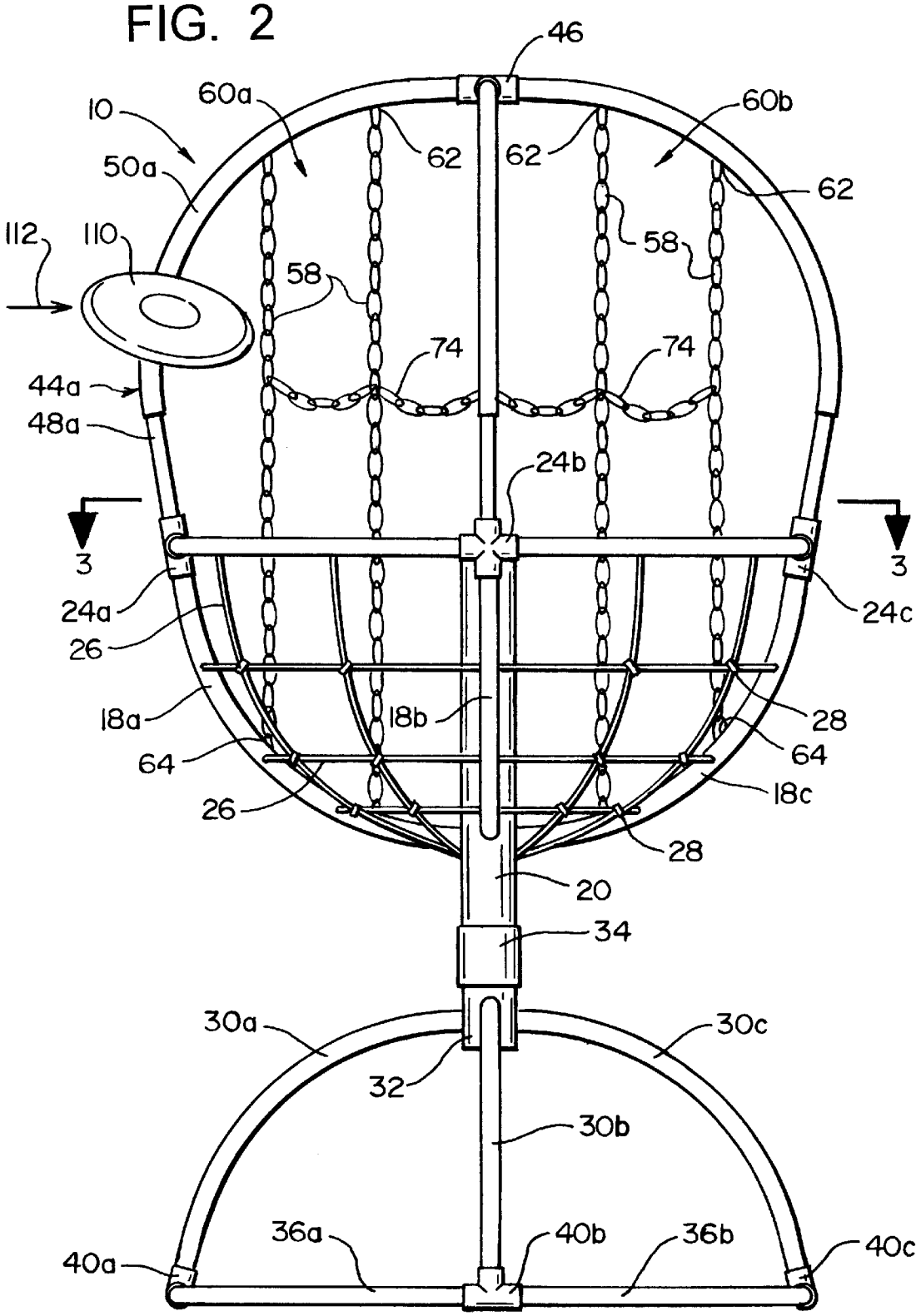
FIG. 2 is a elevational view of the target assembly of FIG. 1, showing the structure thereof in greater detail.

To give the support members 44*a–d* the curvature which is shown in FIGS. 1–2 (which provides the target assembly with advantages which are described below), the lower sections 48*a–d* of the support members preferably extend upwardly and slightly outwardly, generally in-line with the pipe connectors, while the upper sections 50*a*–50*d* bend back inwardly towards the apex of the assembly. The arched support members 44*a*–44*d* thus define a large, somewhat fan shaped capture area 52 for receiving flying discs.

Figure 3:
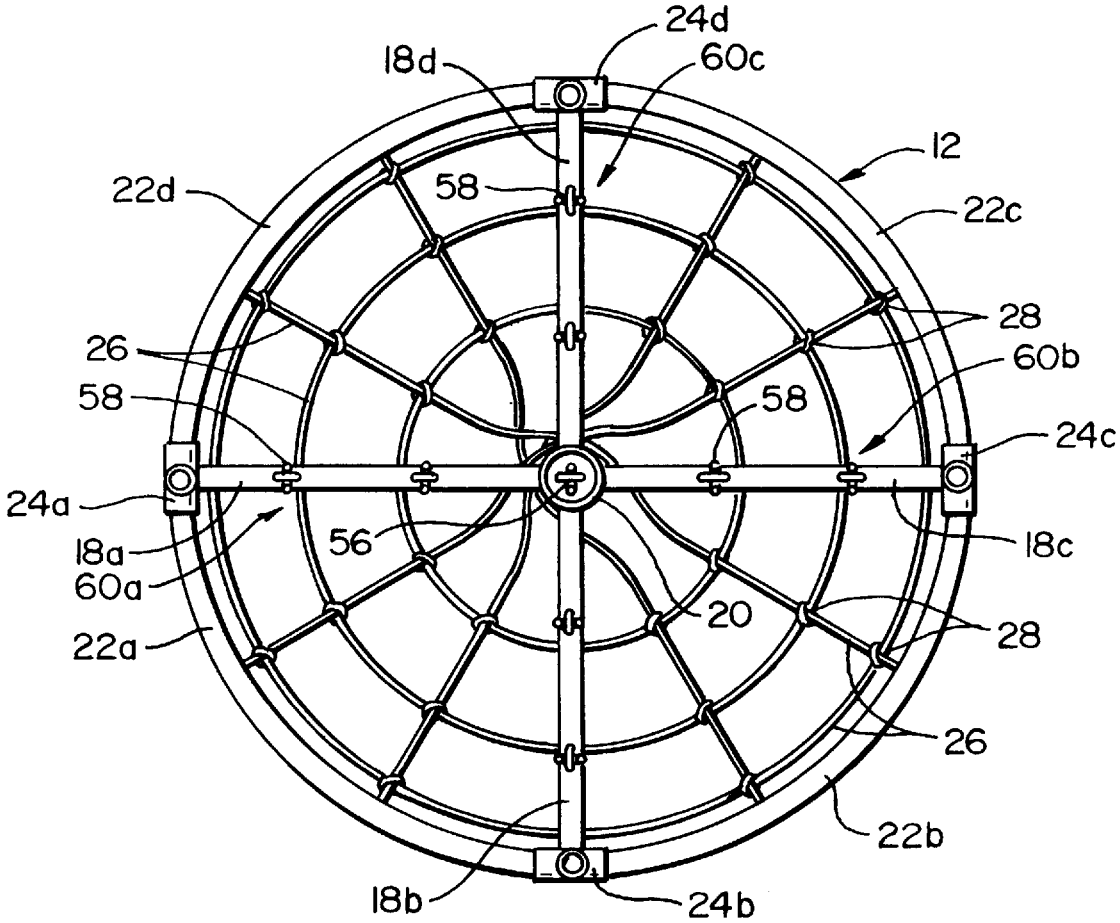
FIG. 3 is a cross-sectional view, taken along line 3—3 in FIG. 2, showing the basket portion of the assembly in greater detail.

A plurality of vertical chains 54, in turn, are suspended from the support members for intercepting discs which enter the capture area, the spacing between adjacent chains being somewhat less than the diameter of the discs with which the target is intended to be used. As can be seen in FIGS. 1–2, the chains 54 include a central segment 56, which extends vertically from an upper end which is mounted to connector 46 to a lower end which is received in pillar tube 20. The surrounding chain segments 58, in turn, are mounted vertically between corresponding pairs of arched support members 44*a–d* and basket support members 18*a–d* so as to form a series of curtains or screen sections 60*a*, 60*b*, 60*c* (see also FIG. 3). The lengths of the vertical chain segments 58 are approximately equal to the distances between their upper and lower attachment points 62, 64, so as to avoid developing any excessive slack.

Figure 4:
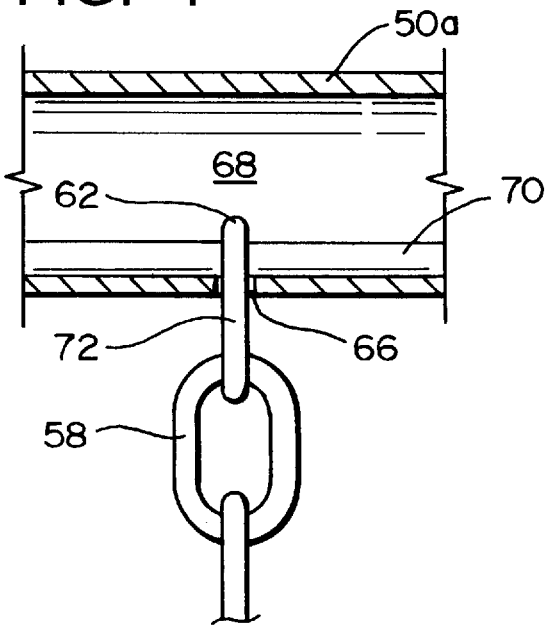
FIG. 4 is a lengthwise cross-sectional view of one of the tubular support members of the target assembly of FIGS. 1–2, showing the manner in which the upper ends of the interception chains are retained in the support members by elongate stringers which are threaded therethrough.
Figure 5:
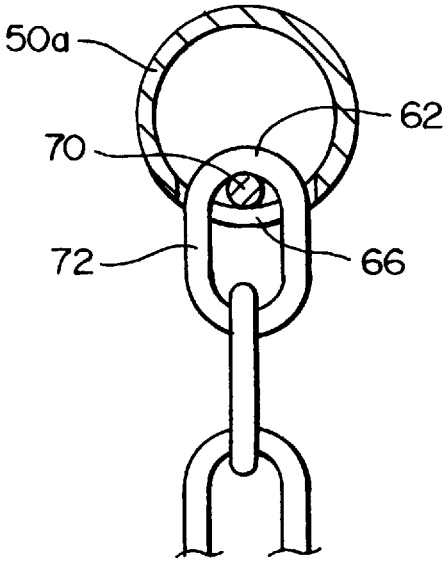
FIG. 5 is a transverse cross-sectional view of the tubular member of FIG. 4, showing the chain connection in additional detail.

As is shown in FIGS. 4–5, the ends 62 of the chain segments 58 are preferably attached to the tubular supports using internal connections. As can be seen, the ends of the chains are inserted through corresponding openings 66 and into the hollow interiors 68 of the tubular support members. A stringer rod 70 is then threaded through the interior of the supports so that this passes through the most uppermost links 72, thereby securing the chains to the support members. The stringer 70 is preferably formed of a flexible material, such as flexible plastic rod, which allows easy assembly/disassembly of the structure, and which also permits the rod to be withdrawn and bent in different directions when the assembly is converted to an alternate configuration.

Furthermore, the vertical chain segments 56, 58 are interconnected proximate their midpoints by horizontally extending chain segments 74 (see FIG. 2). The horizontal chain segments give the screen sections 60*a–c* added cohesion, and prevent adjacent vertical segments from spreading apart when these are impacted by a disc.

In the preferred embodiments which are shown in the figures, the interception structure is mounted above the basket structure which serves as the receiving area for the discs. It will be understood, however, that the interception structure may be used with other forms of receiving areas, such as simply a receiving area drawn or otherwise indicated on the underlying ground, for example.

Figure 6:
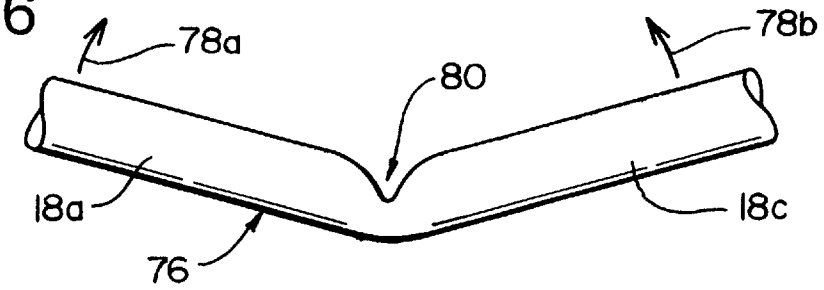
FIGS. 6–8 are sequential views showing the manner in which a portion of the target of FIGS. 1–2 is assembled by crimping tubular members and inserting these through a main vertical support tube of the assembly.
Figure 7:
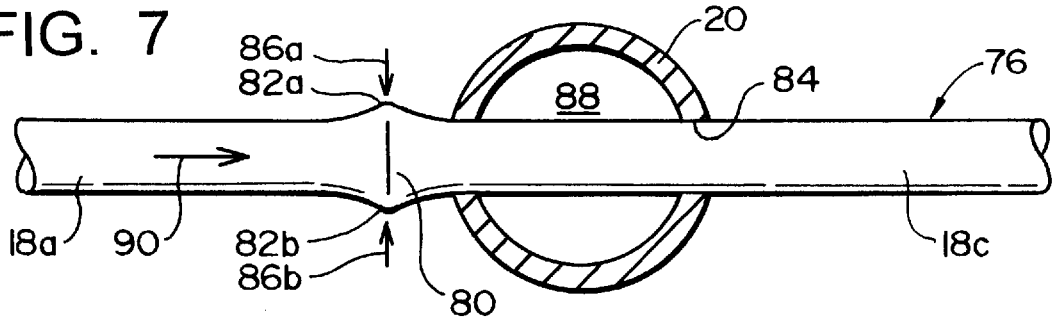
Figure 8:
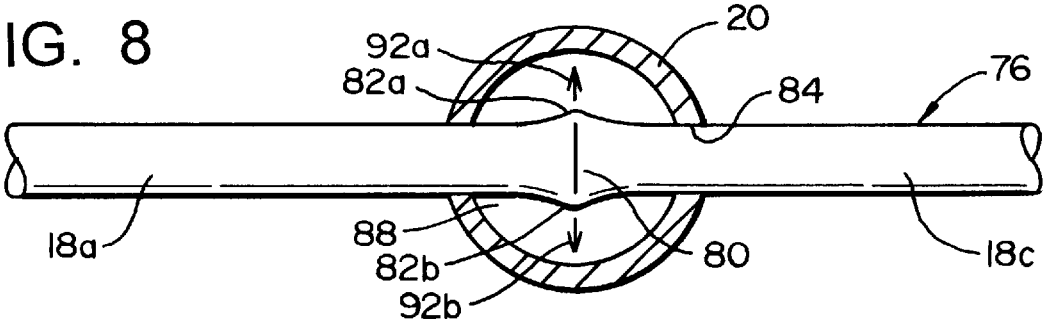

FIGS. 6–8 show one manner in which the tubular support members of the basket structure may be mounted to the pillar tube so as to remain generally centered therein after assembly, this technique being best suited to those embodiments in which the support members are formed of a resiliently flexible material, such as polyethylene pipe.

As can be seen in FIG. 6, each pair of support members may be formed of a single, elongate tubular member 76. To assemble the basket structure, the two ends of the tubular member 76 are bent upwardly towards one another, in the directions indicated by arrows 78*a*, 78*b*, until a central kink 80 is formed. The kink 80 deforms the material and forces this outwardly so as to form laterally extending bulges 82*a*, 82*b*, which define an effective width which is greater than the diameter of the corresponding opening 84 in the pillar tube. When the ends of the member are spread apart, however, the bulges flex back inwardly, as indicated by arrows 86*a*, 86*b*. This reduces the width at the kink, thereby allowing the member to be inserted through bore 84 and into the interior 88 of the pillar tube, as indicated by arrow 90.

Once the kink is centered in the pillar tube, the ends of the tubular member 76 are bent upwardly and joined to the rim of the basket section, as shown in FIGS. 1–2. As this is done, the bulges 82*a*, 82*b* expand back outwardly, as indicated by arrows 92*a*, 92*b* in FIG. 8. This increases the width of member 76 so as to prevent it from being withdrawn through bore 84, so that the support member and pillar tube are locked together once assembled.

In addition to the basket supports 18*a–d*, the legs 30*a–d* and central tube 32 of the stand section 14 can be joined in a similar manner. It will also be understood that the members may be joined in other suitable ways, particularly in those embodiments where the members are form of a rigid material rather than flexible pipe.

b. Configurations

Referring again to FIGS. 1–2, it will be appreciated that the arrangement of the screen sections 60*a*–60*c* imparts a directional bias to the target assembly. In particular, because of the asymmetrical arrangement of the screen sections (i.e., the screen sections are mounted to three pairs of support members, but not the fourth), the target assembly 10 will tend to more readily capture a disc which enters it from one direction than another.

This directional bias adds an element of individuality and challenge to the target, somewhat analogous to the slope or other characteristics of a putting green in conventional golf. For example, the directional targets can be arranged so that the optimal disc flight pattern to "hole out" is a more challenging curved flight path, rather than a straight path directly at the target; this is analogous to the situation in conventional golf, where putts on contoured greens require that the ball follow a curved path to the hole. Moreover, for the sake of variety, the assembly 10 can be turned in one direction or the other in order to periodically change the most advantageous direction of throw. Also, the number of screen sections can be reduced or increased as desired, e.g., screen sections can be fitted to one, two, three, or all four pairs of support segments in the embodiment which is shown in FIGS. 1–2.

Still further, as was noted above, the target assembly in accordance with a preferred embodiment of the invention is convertible between two alternate configurations. In particular, FIG. 9 shows the target assembly 10 of FIGS. 1–2 with the upper interception structure 14 having been converted from the somewhat fan-shaped configuration described above to a more vase-shaped, omni-directional arrangement.

As can be seen in FIG. 9, the basket and stand structures 12–16 of the assembly remain essentially unchanged. In preparation for converting the interception structure 14, however, the lower ends of the support members 44*a–d* are detached from the connectors 24*a–d* around the rim of the basket structure, and their upper ends are detached from the four-way pipe connector 46. Similarly, the upper and lower ends of the chain segments 58 are also detached from the support members.

Then, to reassemble the target in its new configuration, a new circular rim 94 is mounted to the upper ends of the support members 44*a–d*. The rim 94 is similar to the other circular members in the structure, in that this is made up of a plurality of curved members 96*a–d* which are joined in end-to-end relationship by "T"-type pipe connectors 98*a–d*, the upper end of one of the members 44*a–d* being mounted to the third leg of each "T".

The upper ends of the vertical chain members are also mounted to rim 94, in a manner similar to that described above, i.e., the upper ends of the chains are inserted through corresponding openings in the rim and a flexible rod or other stringer is then threaded therethrough. The chain segments are preferably arranged more or less evenly around the rim, at a spacing which is somewhat less than the diameter of a disc which the assembly is designed to intercept.

At the bottom of the interception structure, in turn, the lower ends of the support members 44*a–d* are bundled together and inserted into the upper end of pillar tube 22, so that the members arch upwardly and outwardly therefrom to rim 94. The lower ends 64 of the chain segments are then secured around the bottom of the support members using a flexible rod 100 or other suitable tie or member.

As is also shown in FIG. 9, additional flexible rods are threaded through the chain segments between the upper and lower ends thereof so as to form horizontally extending, outwardly-biased retaining rings 102–104. The rods are suitably formed of a somewhat rigid but still resiliently flexible material, such as the ¼-inch flexible plastic rod material described above. The flexible retaining rings help maintain the shape of the interception structure, and also serve a function similar to that of the horizontal chain segments described above, i.e., these maintain a degree of cohesion between the chain segments and prevent the segments from spreading apart when struck by a disc.

In addition to directing the disc into the underlying basket structure, the outwardly flared supports also form an upper, secondary receiving area 106 for capturing a disc which enters this area in a somewhat vertical direction, as indicated by arrow 108 in FIG. 9. The secondary receiving area can be used for various purposes in the play of the game, such as for added points when a disc is successfully placed therein.

c. Operation

The target assembly of the present invention exhibits superior disc capture characteristics when struck in a predetermined direction (i.e., the direction or directions for which the target is configured to receive discs), by virtue of the combination of chain segments and curved, tubular support members which make up the interception structure of the assembly.

As was noted above, the upper support members 44*a–d* are arched/curved in both of the configurations which are shown. Thus, when a disc 110 enters the target (as indicated by arrow 112 in FIG. 2) and impacts one of the tubular support members, the curved surfaces thereof cause the disc to cant or tilt to one side or the other as it is deflected by the member. This abrupt change in direction interrupts the gyroscopic motion of the disc and reduces its kinetic energy. After the momentum of the disc has been dissipated by the curved support member, it is easily arrested by the chain members and drops into the basket structure of the assembly. Moreover, the absence of any large flat or continuous surfaces on the support members greatly reduces the chance of the disc bouncing back out of the assembly in the event that it strikes one of the members head-on.

Similarly, the chain segments and curved support members cooperate to capture a disc when arranged in the configuration which is shown in FIG. 9. When a disc 110 enters this structure, as indicated by arrow 114, it is more likely to initially strike one of the chain segments than one of the support members. As the chain segments deflects inwardly under the impact, however, the disc again comes into contact with the curved (in this case, outwardly curved) support members 44*a–d*, so that the support members interrupt the flight of the disc and dissipate its energy in the manner described above. Moreover, should the disc happen to pass between the chain segments on one side of the structure (as may happen when the disc is flying at an angle), then it will strike the curved support members and be intercepted by the chain segments on the opposite side of the assembly, in a manner similar to that described above with reference to FIG. 2.

It is to be recognized that various alterations, modifications, and/or additions may be introduced into the constructions and arrangements of parts described above without departing from the spirit or ambit of the present invention.

What is claimed is:

1. A disc golf target assembly, comprising:

a disc interception structure for arresting a flying disc; and a disc receiving area positioned below said disc interception structure for holding a disc which has been arrested by said interception structure;

said disc interception structure comprising:

at least one curved support member that extends upwardly primarily in a vertical direction for upsetting the flight of a disc from a primarily horizontal orientation to a primarily vertical orientation, so as to reduce momentum of a disc in response to a disc striking said curved support member; and at least one chain segment suspended from said curved support member for arresting forward motion of a disc in response to a disc striking said chain segment;

so that said chain segment and said curved support member cooperate to intercept a disc so that a disc falls from said interception structure into said receiving area.

2. The target assembly of claim 1, wherein said at least one curved support member comprises:

a plurality of elongate support members which extend generally upwardly above said receiving area.

3. The target assembly of claim 2, wherein said plurality of elongate support members comprises a plurality of tubular support members.

4. The target assembly of claim 2, wherein said plurality of curved support members comprise:

upper end portions of said elongate support members which arch over said receiving area of said assembly.

5. The target assembly of claim 4, wherein said at least one chain segment comprises:

a plurality of chain segments having upper ends which are mounted to said upper end portions of said support members and extend downwardly therefrom towards said receiving area.

6. The target assembly of claim 5, wherein said upper end portions of said elongate support members are inwardly arched over said receiving area.

7. The target assembly of claim 5, wherein said upper end portions of said elongate support members are outwardly arched over said receiving area.

8. The target assembly of claim 5, wherein said interception structure is convertible from a first configuration in which said upper end portions of said elongate support members are inwardly arched over said receiving area, to a second configuration in which said elongate support members are outwardly arched over said receiving area.

9. The target assembly of claim 6, wherein said plurality of chain segments comprises:

a plurality of chain segments having upper ends mounted in a row to an inwardly arched upper end of at least one of said curved support members so as to form a screen section which extends downwardly therefrom for intercepting a flying disc in said assembly.

10. The target assembly of claim 9, wherein at least one of said plurality of support members is free from having a screen section mounted thereto, so that said interception structure will preferentially intercept flying discs from at least one predetermined direction.

11. The target assembly of claim 9, wherein said receiving area comprises:

a basket structure having an a capture area for receiving discs therein and an upper rim which extends around said capture area.

12. The target assembly of claim 11, wherein said plurality of curved support members further comprises:

a plurality of lower end portions of said support members which are mounted at spaced locations around said upper rim of said basket structure.

13. The target assembly of claim 12, further comprising:

a connector for joining said inwardly arched upper end portions of said support members over said receiving area.

14. The target assembly of claim 7, wherein said interception structure further comprises:

an upper ring member which is mounted to said outwardly arched upper end portions of said elongate support members.

15. The target assembly of claim 14, wherein said plurality of chain segments comprises:

a plurality of chain segments having upper ends mounted at spaced locations to said upper ring member of said interception structure and which extend downwardly around said support members for intercepting a flying disc in said assembly.

16. The target assembly of claim 15, wherein said plurality of chain segments have lower ends which bow inwardly towards lower end portions of said support members.

17. The target assembly of claim 16, wherein said interception structure further comprises:

a means for retaining lower ends of said plurality of chain segments around said lower end portions of said support members.

18. The target assembly of claim 17, wherein said interception structure further comprises:

at least one flexible, generally horizontal ring member surrounding said support members and mounted to said plurality of chain segments between said upper and lower ends thereof.

19. The target assembly of claim 15, further comprising:

a vertically extending pillar tube having an open upper end in which lower end portions of said curved support members are received and retained.

20. The target assembly of claim 1, further comprising a base structure for supporting said interception structure and receiving area above ground level.

* * * * *